US006265679B1

(12) United States Patent
Lexer et al.

(10) Patent No.: US 6,265,679 B1
(45) Date of Patent: Jul. 24, 2001

(54) SWITCHING ELEMENT, IN PARTICULAR A PRESSURE-WAVE SWITCH

(75) Inventors: Christof Lexer, Jestetten (DE); Godert De Jager, Volketswil (CH)

(73) Assignee: Bircher AG (CH)

( * ) Notice: Subject to any disclaimer, the term of this patent is extended or adjusted under 35 U.S.C. 154(b) by 0 days.

(21) Appl. No.: 09/553,505

(22) Filed: Apr. 20, 2000

(30) Foreign Application Priority Data

Apr. 22, 1999 (DE) ..... 199 18 208

(51) Int. Cl.[7] ..... H01H 35/34

(52) U.S. Cl. ..... 200/83 R; 200/61.43; 200/242

(58) Field of Search ..... 200/61.41–61.43, 200/61.71, 61.73, 61.81, 81 R, 81.8, 81.9 R, 83 R, 83 A, 83 N, 83 V, 83 Z, 81 H, 85 R, 241, 242

(56) References Cited

U.S. PATENT DOCUMENTS

| | | | | |
|---|---|---|---|---|
| 3,862,387 | * | 1/1975 | Phillips et al. | 200/83 N |
| 3,938,076 | * | 2/1976 | Hayashi | 340/58 |
| 4,365,124 | * | 12/1982 | Robinson | 200/81.5 |
| 5,568,860 | * | 10/1996 | Stringwell et al. | 200/242 |
| 5,728,984 | * | 3/1998 | Miller | 200/61.43 |
| 5,888,381 | * | 3/1999 | Primdahl et al. | 210/87 |

FOREIGN PATENT DOCUMENTS

| | | | |
|---|---|---|---|
| 2254228 | 5/1974 | (DE) | H01H/35/34 |
| 3110699 | 10/1982 | (DE) | H01H/35/34 |
| 3311083 | 9/1984 | (DE) | H01H/35/34 |
| 3340436 | 5/1985 | (DE) | H01H/35/34 |
| 3541298 | 4/1987 | (DE) | H01H/35/34 |
| 3819458 | 12/1989 | (DE) | H01H/35/34 |
| 3941780 | 6/1990 | (DE) | H01H/35/34 |
| 4202144 | 7/1992 | (DE) | H01H/35/34 |
| 4111338 | 10/1992 | (DE) | H01H/35/34 |
| 4300171 | 7/1994 | (DE) | F16P/3/08 |
| 4328824 | 3/1995 | (DE) | H01H/13/70 |
| 4332487 | 3/1995 | (DE) | H01H/35/34 |
| 19808559 | 9/1999 | (DE) | H01H/35/34 |

* cited by examiner

*Primary Examiner*—Michael Friedhofer
(74) *Attorney, Agent, or Firm*—Bachman & LaPointe, P.C.

(57) ABSTRACT

In a switching element, in particular a pressure-wave switch for safeguarding jamming points in the case of operable gates, doors or the like, having at least one pressure chamber which is provided at least partially with a diaphragm (4), it being possible to connect an exciter contact element (5) for making contact with a consumer contact element (6) via the diaphragm (4), it is to be possible for the exciter contact element (5) and/or the consumer contact element (6) to be moved out of a contact plane (E) in order to make common contact.

18 Claims, 2 Drawing Sheets

SWITCHING ELEMENT, IN PARTICULAR A PRESSURE-WAVE SWITCH

BACKGROUND OF THE INVENTION

The present invention relates to a switching element, in particular a pressure-wave switch for safeguarding jamming points in the case of operable gates, doors or the like, having at least one pressure chamber which is provided at least partially with a diaphragm, it being possible to connect an exciter contact element for making contact with a consumer contact element via the diaphragm.

Such pressure-wave switches are known and can be obtained on the market in a wide variety of forms and designs. They serve essentially to safeguard jamming points, in particular in the case of operable doors, gates or the like. Use is frequently made of sealed rubber or hollow sections which are connected via a hose to a pressure-wave switch described at the beginning. Given a specific pressure on the hose when, for example, a door, a gate, window or the like is closed, a pressure is built up in the pressure-wave switch and an electric contact is closed between an exciter contact element and a consumer contact element. If the door is opened, the pressure in the pressure-wave switch subsides, the diaphragm retracts and an electric contact is interrupted. The latter conducts the corresponding signal, which can be further processed.

In this case, a contact element which is assigned to the diaphragm is moved linearly against a further contact element of a consumer contact element. Contamination and, in particular, wear phenomena frequently occur as a result with such pressure-wave switches. Through frequent operation, electric arcing forms a so-called insulating layer which greatly impairs the reliability of such a pressure-wave switch. Such switches are frequently moved, and so very high demands are placed on wear. These switches react, for example, in the case of an air overpressure in the system of approximately 2 mbar. Upon contact closure, a stop signal or a reverse signal can be passed on at the drive of the door or the gate.

The reliability of such pressure-wave switches is therefore of fundamental importance in safety engineering. Operations frequently proceed in this case with contact gaps and low contact pressures, resulting in contamination, oxidation of the contacts even in the case of low currents such as occur, for example, in driving digital circuits.

SUMMARY OF THE INVENTION

It is the object of the present invention to create a switching element, in particular a pressure-wave switch of the type mentioned at the beginning, which eliminates the said disadvantages, and with the aid of which permanent switching is possible in a simple and cost-effective and reliable way without contamination of the contact elements and without the formation of a corroding and insulating layer by electric arcing, and which is reliable in operation.

This object is achieved by virtue of the fact that the exciter contact element and/or the consumer contact element can be moved out of a contact plane in order to make common contact.

It is important in the case of the present invention that, when pressure is applied to the pressure-wave switch, the exciter contact element is moved against the consumer contact element by means of the diaphragm. The movement of the contact elements toward one another pushes the contact surfaces over one another. This is ensured permanently during switching on or off of an electric connection between the exciter contact element and consumer contact element.

It is important in this case that, as they engage on one another, at least one contact element is moved out with respect to the other contact element from a plane of the contact element.

This outward movement of the contact elements against one another from the contact plane is ensured by virtue of the fact that imaginary fulcrums of the individual exciter contact elements and of the consumer contact element lie outside the contact plane.

These imaginary fulcrums preferably lie in a diaphragm plane. In this case, the contact elements of the exciter contact element and of the consumer contact element lie outside the diaphragm plane. Only in this way is a permanently sliding movement of the contact elements toward one another ensured as they touch. In particular, this prevents an insulating layer from building up. In this case, as they engage one another and come out of engagement, the contact elements are always pushed over one another, with the result that the contact surfaces are freed from dirt and any possible corrosion is prevented.

Consequently, the present invention gives rise to a switching element, in particular a pressure-wave switch which operates in a maintenance-free fashion with a substantially enhanced reliability.

The scope of the present invention is also intended to cover the employment and use of the corresponding exciter contact element and of the consumer contact element in the case of an underpressure-wave switch. The exciter contact element then correspondingly reaches over the consumer contact element. This is also intended to be covered by the present inventive concept.

BRIEF DESCRIPTION OF THE DRAWINGS

Further advantages, features and details of the invention emerge from the following description of preferred exemplary embodiments and with the aid of the drawing, in which.

DETAILED DESCRIPTION OF PREFERRED EMBODIMENTS

Figure 1:
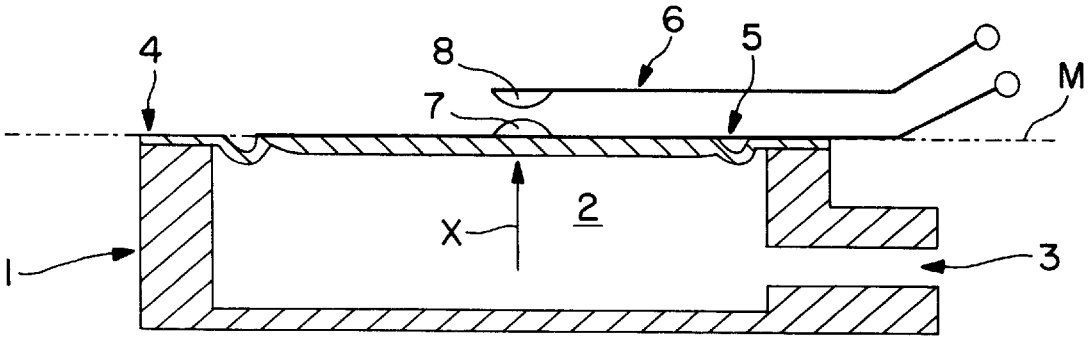
FIG. 1 PRIOR ART
FIG. 1 shows a schematic cross section through a pressure-wave switch according to the prior art.

In accordance with FIG. 1, a pressure-wave switch known to date has a housing 1 in which a pressure chamber 2 is formed internally. Opening into the pressure chamber 2 is a connection 3 for the application of a compressed air hose or similar element. The pressure chamber 2 is covered by a diaphragm 4 which can be moved with respect to the housing 1 when pressure is applied in the illustrated direction of the arrow X. In this case, an exciter contact element 5 applied to the diaphragm 4 is moved against a consumer contact element 6, and electric contact is made.

If the pressure in the pressure chamber 2 subsides, the diaphragm is moved back counter to the illustrated direction of the arrow X, which entails moving apart the contact elements 7, 8. The electric contact is interrupted.

Figure 2:
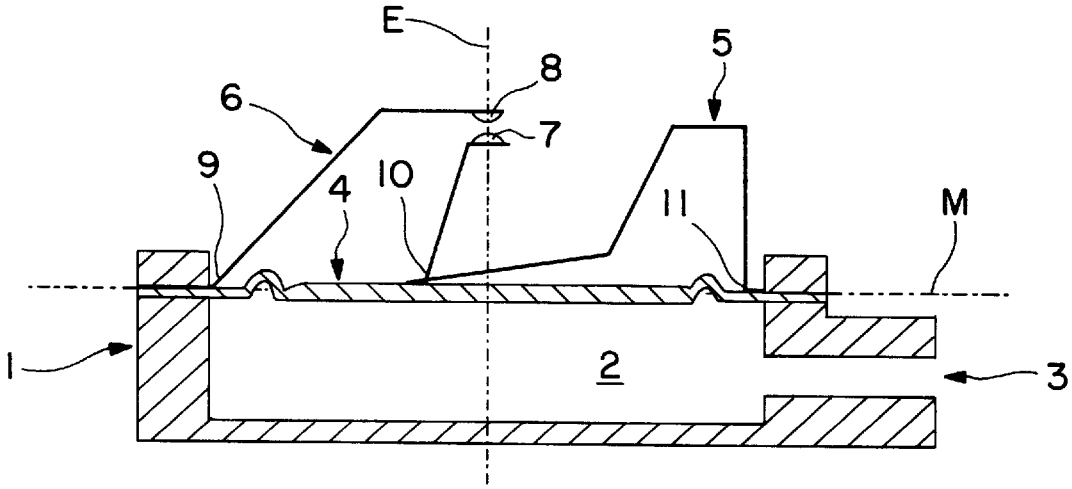
FIG. 2 shows a schematic cross section through a switching element according to the invention, in particular through a pressure-wave switch.

In the present invention, in accordance with the exemplary embodiment according to FIG. 2, the exciter contact element 5 and consumer contact element 6 and, in particular, the contact elements 7, 8 of the latter lie outside a diaphragm plane M. Furthermore, the exciter contact element 5 and consumer contact element 6 can be pivoted outward onto one another about imaginary fulcrums 9, 10 and 11 by movement of the diaphragm 4 when pressure is applied to the contact elements 7, 8. The imaginary fulcrums 9 and 11 of the consumer contact element 6 and exciter contact element 5, respectively, preferably lie outside a contact plane E.

As a result, as the exciter contact element 5 and the consumer contact element 6 strike one another and move against one another, a sliding movement is produced on the contact elements 7, 8 with the result that the contact elements 7, 8 move against one another during the process of touching. Consequently, an insulating layer is prevented from being built up, the contact surfaces remain permanently engaged on one another during operation, and the contact contamination problems are solved in this way.

This movement of the contact elements 7, 8 against one another is achieved by virtue of the fact that the contact elements 7, 8 and, in particular, the exciter contact element 5 as well as the consumer contact element 6 are arranged outside the diaphragm plane M. It is important, moreover, that the imaginary fulcrums 9, 11 are also arranged outside the contact plane E and preferably close to the diaphragm plane M, in order to permit an appropriate rolling movement of the contact elements 7, 8 toward one another when pressure is applied to the diaphragm 4.

Figure 3:
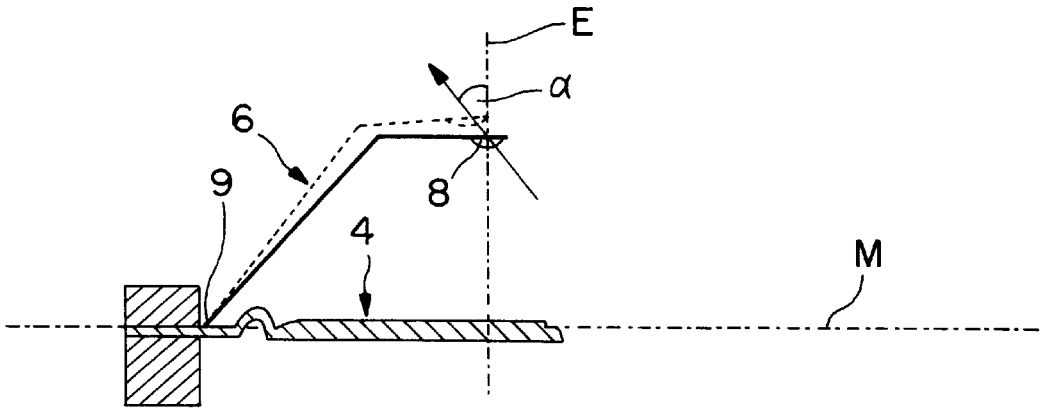
FIG. 3 shows a partial cross section through the pressure-wave switch in accordance with FIG. 2, in a position of use.

In the exemplary embodiment in accordance with FIG. 3, a deflected position, illustrated with dashes, after pressure has been applied to the consumer contact element 6 is indicated. The consumer contact element 6 pivots about the imaginary fulcrum 9, resulting in a direction of movement of the consumer contact element 6 as indicated in the illustrated direction of the arrow. The imaginary direction of movement toward the contact plane E encloses an angle $\alpha$ which is between 10 and 40, preferably 30 degrees. In this case, for example, only the contact element 8 can be moved linearly in the contact plane E, the contact elements 7, 8 still moving against one another.

Figure 4A:
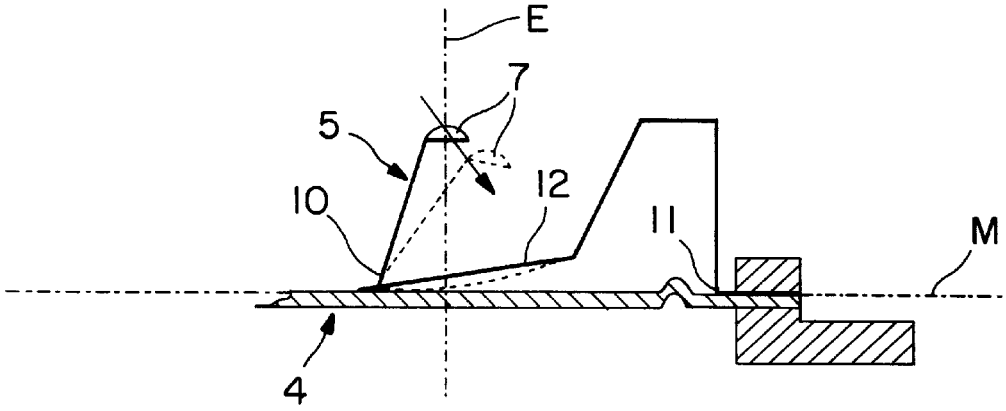
FIG. 4*a* shows a further partial cross section of the pressure-wave switch in accordance with FIG. 2, in a further position of use.
Figure 4B:
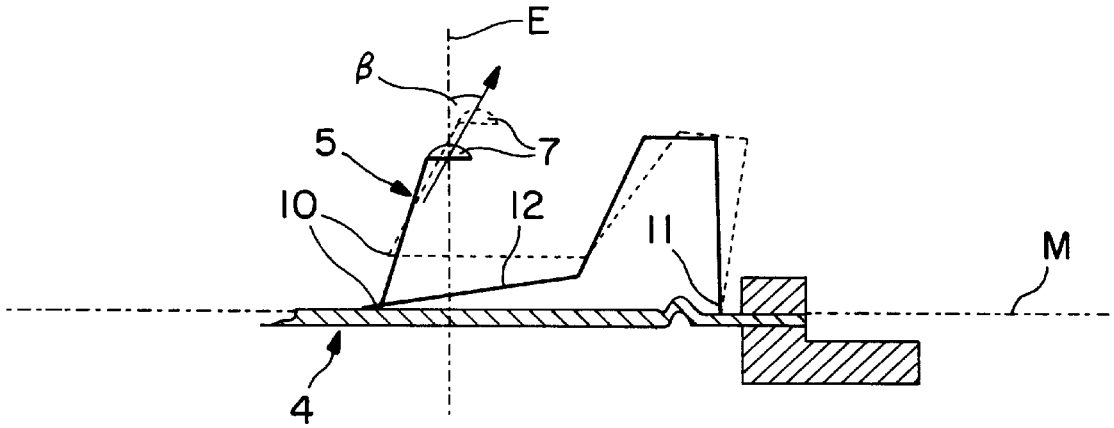
FIG. 4*b* shows a partial cross section through the pressure-wave switch in accordance with FIG. 2, in yet a further position of use.

However, the contact element 7, in particular the exciter contact element 5, is preferably pivoted about the imaginary fulcrum 10 and/or about the imaginary fulcrum 11, as also illustrated in FIG. 4*b*, thus permitting a movement of the contact element 7 out of the contact plane E. In this case, the imaginary fulcrum 10, 11 lies outside the contact plane E and preferably near the diaphragm plane M.

The direction of movement of the exciter contact element 5, as illustrated in particular in FIG. 4*b*, describes a pivoting movement about the imaginary fulcrum 10 and/or 11 out of the contact plane E. As a result, when it is moved with respect to the contact element 8, the contact element 7 slides on the radius thereof, thus ensuring the maintenance of a permanent electric connection. Particles of dirt or the like are removed by this movement of sliding and displacement against one another. Likewise, the fact that the contact elements 7, 8 are continuously pushed and rubbed over one another prevents an insulating layer from building up.

It is also important in the present invention that only one such movement of the exciter contact element 5 or the consumer contact element 6 suffices to ensure such a pushing over one another, at least in smaller regions on the radius of the contact elements 7, 8, in order to eliminate the above-named disadvantages.

However, the exciter contact element 5 and consumer contact element 6 are preferably moved against one another. In this case, the contact elements 7, 8 respectively move out of the contact plane E toward the respective imaginary fulcrums 9, 11. Consequently, the contact elements 7, 8 move over one another and are permanently engaged when pressure is applied to the switching element R, in particular the diaphragm 4.

In the exemplary embodiment in accordance with FIG. 4*a*, the exciter contact element 5 is provided with a holding arm 12 which bears in part against the diaphragm 4 and is cambered downward about the imaginary fulcrum 11, if appropriate by the application of pressure and by bending, with the result that the holding arm 12, as represented by dashes, rolls on the diaphragm 4. This spares the diaphragm 4 and effects a harmonic rolling and/or sliding movement of the contact element 7 on the contact element 8 of the consumer contact element 6.

Furthermore, the present inventive concept covers the fact that, in a rest position, the two contact elements 7, 8 are not interrupted, as illustrated in FIG. 2, but bear against one another, if appropriate under a slight pressure. An electric connection is permanently present.

If an underpressure prevails in the pressure-wave switch, in particular in the pressure chamber 2, the diaphragm 4 is moved inward counter to the direction of the arrow X illustrated in FIG. 1, this then opening the contact elements 7, 8 which are closed relative to one another in a rest position.

It is thereby possible for the switching element according to the invention also to be driven by means of underpressure.

The present invention also covers the fact that, for example, the exciter contact element 5, which is operated by the diaphragm 4, is not, as illustrated in FIG. 2, arranged below the contact element 8 or below the consumer contact element 6, but reaches over the latter. Consequently, an existing connection of the contact elements 7, 8 can be interrupted by means of applying pressure, in particular overpressure, to the pressure chamber 2, and of a resulting deflection of the diaphragm 4 in the X-direction. It is also conceivable in the case of underpressure, when the contact elements 7, 8 are interrupted relative to one another, that an appropriate electrical connection is produced by closing the contact elements 7, 8.

What is claimed is:

1. A switching element, which comprises: a pressure-wave switch for safeguarding jamming points; including at least one pressure chamber which is provided at least partially with a diaphragm; an exciter contact element operative to contact a consumer contact element via said diaphragm; wherein at least one of the exciter contact element and the consumer contact element can be moved out of a contact plane (E) in order to make common contact against each other.

2. The switching element as claimed in claim 1, wherein when pressure is applied to the exciter contact element against the consumer contact element, said exciter contact element and consumer contact element can be moved away laterally out of said contact plane (E), as a result of which individual contact elements of the exciter contact element and the consumer contact element can be moved in a manner bearing against one another.

3. The switching element as claimed in claim 2, wherein fulcrums of at least one of the exciter contact element and the consumer contact element lie approximately in a common diaphragm plane (M).

4. The switching element as claimed in claim 1, wherein at least one holding arm of the exciter contact element is connected to the diaphragm.

5. The switching element as claimed in claim 4, wherein said at least one holding arm can be bent.

6. The switching element as claimed in claim 4, wherein said at least one holding arm can be rolled on the diaphragm.

7. The switching element as claimed in claim 1, wherein, when pressure is applied to the pressure chamber, the diaphragm can be moved away from the pressure chamber and, as a result, the exciter contact element can be moved against the consumer contact element.

8. The switching element as claimed in claim 1, wherein, when pressurized by means of said diaphragm, at least one of the exciter contact element and the consumer contact element can be at least one of (1) moved out of a diaphragm plane (M), and (2) pivoted out of the contact plane (E) about a fulcrum.

9. The switching element as claimed in claim 1, wherein a direction of movement of at least one of the exciter contact element and the consumer contact element encloses an angle of approximately 10 to 40 degrees with said contact plane.

10. The switching element as claimed in claim 1, wherein at least one of the exciter contact element and the consumer contact element are arranged spaced from a housing for said switching element.

11. The switching element as claimed in claim 1, wherein in order to make common contact in a rest position of the diaphragm, the exciter contact element and the consumer contact element are in contact with one another.

12. The switching element as claimed in claim 11, wherein in order to make electric contact, the exciter contact element can be moved with respect to the consumer contact element.

13. The switching element as claimed in claim 12, wherein, in order to make electric contact, the exciter contact element can be moved one of (1) onto the diaphragm against the consumer contact element to close the electric connection, and (2) out of a closed rest position away from the consumer contact element.

14. The switching element as claimed in claim 1, wherein the exciter contact element reaches over the consumer contact element and electric contact is made or interrupted.

15. A switching element, which comprises: a pressure-wave switch for safeguarding jamming points; including at least one pressure chamber which is provided at least partially with a diaphragm; an exciter contact element operative to contact a consumer contact element via said diaphragm; wherein fulcrums of at least one of the exciter contact element and the consumer contact element lie outside of a common contact plane (E); and wherein, when pressure is applied to the exciter contact element against the consumer contact element, said exciter contact element and consumer contact element can be moved away laterally out of said contact plane (E), as a result of which individual contact elements of the exciter contact element and the consumer contact element can be moved in a manner bearing against one another.

16. The switching element as claimed in claim 15, wherein at least one of said fulcrums of the exciter contact element and of the consumer contact element are arranged situated approximately opposite said contact plane (E).

17. A switching element, which comprises: a pressure-wave switch for safeguarding jamming points; including at least one pressure chamber which is provided at least partially with a diaphragm; an exciter contact element operative to contact a consumer contact element via said diaphragm; including individual contact elements connected to the exciter contact element and the consumer contact element, which individual contact elements are arranged spaced from a diaphragm plane (M); wherein, when pressure is applied to the exciter contact element against the consumer contact element, said exciter contact element and consumer contact element can be moved away laterally out of a contact plane (E), as a result of which said individual contact elements can be moved in a manner bearing against one another.

18. The switching element as claimed in claim 17, wherein said individual contact elements include curvatures which are arranged against each other.

* * * * *